US007401445B2

(12) United States Patent
Bausch et al.

(10) Patent No.: US 7,401,445 B2
(45) Date of Patent: Jul. 22, 2008

(54) VESSEL-FILLING APPARATUS

(75) Inventors: Franz Hubert Bausch, Spiesen-Elversberg (DE); Uwe Gerasch, Saarbrücken (DE)

(73) Assignee: Hamba Filltec GmbH & Co. KG, Neunkirchen/Saar (DE)

( * ) Notice: Subject to any disclaimer, the term of this patent is extended or adjusted under 35 U.S.C. 154(b) by 55 days.

(21) Appl. No.: 11/407,405

(22) Filed: Apr. 19, 2006

(65) Prior Publication Data

US 2006/0236656 A1 Oct. 26, 2006

(30) Foreign Application Priority Data

Apr. 21, 2005 (DE) ..... 10 2005 018 659

(51) Int. Cl.
*B65B 5/06* (2006.01)

(52) U.S. Cl. ..... 53/281; 53/467; 53/477; 53/287; 53/302

(58) Field of Classification Search ..... 53/467, 53/477, 478, 281, 287, 299, 302, 329.2, 329.4
See application file for complete search history.

(56) References Cited

U.S. PATENT DOCUMENTS

| | | | | |
|---|---|---|---|---|
| 1,776,350 | A * | 9/1930 | Desobry | 53/77 |
| 3,431,702 | A * | 3/1969 | Spaulding | 53/281 |
| 4,204,382 | A | 5/1980 | Guyonnet | 53/563 |
| 4,520,612 | A | 6/1985 | Muller | 53/48 |
| 4,852,328 | A * | 8/1989 | Culpepper et al. | 53/300 |
| 4,866,907 | A * | 9/1989 | Iuchi et al. | 53/299 |
| 4,930,345 | A | 6/1990 | Bausch | |
| 4,989,393 | A * | 2/1991 | Sell et al. | 53/299 |
| 5,123,227 | A | 6/1992 | Shibauchi et al. | |
| 5,295,343 | A | 3/1994 | Ueda et al. | |
| 6,675,555 | B1 * | 1/2004 | Monti | 53/167 |
| 6,684,602 | B2 | 2/2004 | Reinecke | |
| 6,745,541 | B2 * | 6/2004 | Sakurazawa | 53/307 |
| 6,874,302 | B2 * | 4/2005 | Gambetti | 53/589 |
| 2004/0266597 | A1 | 12/2004 | Melville | 493/149 |

FOREIGN PATENT DOCUMENTS

| | | |
|---|---|---|
| CA | 1185575 | 4/1985 |
| DE | 44 04 984 | 8/1995 |
| DE | 20305759 | 2/2004 |
| DE | 10322556 | 4/2004 |
| EP | 0 084 442 | 7/1983 |
| EP | 0 046 531 | 7/1985 |
| EP | 1 598 275 | 11/2005 |
| EP | 1598275 | 11/2005 |
| WO | 01/288 58 | 4/2001 |
| WO | 03/016144 | 2/2003 |

* cited by examiner

*Primary Examiner*—Hemant M Desai
(74) *Attorney, Agent, or Firm*—Andrew Wilford

(57) ABSTRACT

A conveyor moves in a horizontal transport direction through a closing station and has plates forming a succession of transverse rows of cutouts each holding a respective vessel. A stationary main frame at the station is traversed by the conveyor extends. A secondary frame is carried by guides on the main frame for movement of the secondary frame between a use position in the main frame above the conveyor and a service position projecting transversely from the main frame and supported horizontally transversely offset from the conveyor. A plurality of respective sealing heads carried on the secondary frame can put covers on the vessels when the secondary frame is in the use position.

21 Claims, 7 Drawing Sheets

10
31
31
31
31
25
24
32
35
34
36
11
S
47
48
23
OT
47
37
36
13
12
13
37
14
16
23
B
17
R2
F
R1
28
23
35
27
26
32
33
II
15
B
22
15
21
UT
15
18
R1
R2
15
x
22
20
T

VESSEL-FILLING APPARATUS

FIELD OF THE INVENTION

The present invention relates to an apparatus for filling vessels. More particularly this invention concerns the filling of cups, bottles, or the like with a fluent foodstuff.

BACKGROUND OF THE INVENTION

In commonly owned U.S. Pat. No. 6,684,602 a bottling apparatus is described having a frame having a horizontally extending upper portion and a horizontally extending lower portion separated from the upper portion by an open space and an endless conveyor element on the frame having a horizontal lower stretch in the frame lower portion, an upper stretch above the space in the frame upper portion, and upstream and downstream upright stretches extending between and interconnecting upstream and downstream ends of the upper and lower stretches. A drive advances the element continuously in a horizontal transport direction in the lower stretch. A plurality of holders secured to the element each form a transverse row of seats adapted to fit snugly around necks of respective bottles that are loaded into the holders at the upstream end of the lower stretch with mouths of the bottles open upward into the space and the bottles hanging by their necks from the lower stretch. Machines or subassemblies carried on the frame lower portion in the space below the frame upper portion clean, fill, and cap bottles in the seats moving in the transport direction. A device for checking the seal of the covers applied to vessels in such an apparatus is described in U.S. Pat. No. 4,930,345.

Such an apparatus can be used to fill bottles, cups, and the like with a fluent food stuff. For instance upwardly flaring cups can be filled with yogurt and a flat metallic-foil cover disk can be applied to the upper rim after filling. A conveyor typically formed as upper and lower stretches passes in a horizontal transport direction through a frame of the apparatus, and forms a plurality of rows each extending horizontally perpendicular to the direction. The apparatus normally has a vessel-loading unit at its upstream end that loads the rows and an unloading unit at the downstream end. Between the ends is a filling station where at least one row of the vessels is filled at a time, and between the filling station and the unloading station is a sealing/capping station where the covers are applied. A cover testing device with a reject puller can be provided between the sealing station and the unloading station.

The capping or cover-applying unit typically forms a separate subassembly having at least one row of cappers each provided with one container receptacle, corresponding in number to the amount of container receptacle lines. An example for such a capper might be a closing head for lid foils of food containers with hot-melt adhesive coating on the insides according to DE 44 04 984. Several such closing heads are for example aligned in a row extended perpendicular to the transport direction of the device, as well as combined to a structural component, the closing subassembly. This subassembly is very complex and, because it is dealing with open containers often filled with a semiliquid foodstuff, frequently gets very messy. Thus it needs to be maintained and cleaned frequently.

OBJECTS OF THE INVENTION

It is therefore an object of the present invention to provide an improved vessel-filling apparatus.

Another object is the provision of such an improved vessel-filling apparatus that overcomes the above-given disadvantages, in particular that is that, in spite of being able to fill and close vessels at a high production rate, is still being easy to service and clean.

SUMMARY OF THE INVENTION

A conveyor moves in a horizontal transport direction through a closing station and has plates forming a succession of transverse rows of cutouts each holding a respective vessel. A stationary main frame at the station is traversed by the conveyor extends. A secondary frame is carried by guides on the main frame for movement of the secondary frame between a use position in the main frame above the conveyor and a service position projecting transversely from the main frame and supported horizontally transversely offset from the conveyor. A plurality of respective sealing heads carried on the secondary frame can put covers on the vessels when the secondary frame is in the use position.

Thus the closing subassembly is carried by the guides is and can be positioned with the help of the guide in the main frame, as well as moved out of the main frame to the sides and can be set completely outside the main frame in the service position that allows free access to the cappers.

The device according to the invention in the broadest sense allows the whole closing subassembly to be moved with the help of its coordinated guide from the main frame into the service position where the closing subassembly and especially its cappers are freely accessible. In this manner unobstructed maintenance of the cappers is rendered possible, in particular parts can be replaced significantly faster then before, thus avoiding longer down times.

The device according to the invention is particularly advantageous in connection with the closing subassemblies containing heat-sealing-heads, also called sealers. The sealing heads have always been with the prior-art equipment very hard to access for maintenance reasons, which is of particular disadvantage as far as broader cup- or bottle-filling devices are concerned. Furthermore, contamination of such heat-sealing heads due to melting loss or residues of the sealing wire cannot be avoided. If necessary, such contaminations have to be removed with the help of a tool, in particular a steel brush. In doing so, cleaning residue regularly falls off and pollutes the carrier elements or cell plates and conveyor chains.

In addition the device according to the invention removes the so far existing difficulties regarding a change of the cup or lid dimensions, for example from a lid perimeter of 75 mm to 95 mm. A device according to the invention can easily be adapted to such a change in dimensions, due to easy removal of the sealing heads of the closing subassembly that is freely accessible in the service position.

The guide according to the invention can be designed in different ways. Nonetheless the invention prefers special guide as will be described in the following.

According to one variant of the invention the guiding mean consists of a hinge on a narrow side of the closing subassembly and by which the closing subassembly can be swivelled about a vertical axis out of the main frame. In this connection the construction is simple, if the closing subassembly can be swivelled parallel to the main level of the carrier elements, e.g. the cell plates or cell temples. Thus the secondary frame carrying the sealing heads in this arrangement is formed at one of the four corner columns as a hinge and supports are provided on the other three columns. Thus when in the use position the secondary frame is supported by the hinge and the supports on the three columns. In the service position it is swung out in a horizontal plane and is supported solely on the one hinge, but since it is not active in this position the somewhat less stable mounting is not important.

In a further embodiment according to the invention the guide consist of a straight telescoping rail can laterally move the closing subassembly out of the main frame thanks to a translatory movement, sliding out like a drawer.

A simple construction and configuration of such a straight guide is according to the invention guaranteed by the fact that the closing subassembly can be moved out of the main frame in a translatory movement on a level parallel to the main level of the carrier elements, that is in a horizontal plane in a direction perpendicular to the transport direction.

The invention particularly prefers such a straight guide that consists of at least one telescopic rail. Such telescopic rails are of particular advantage as with a corresponding configuration they carry a considerable load, even if completely extended, which is of particular importance in connection to a closing subassembly according to the invention. Such telescopic rails containing balls or running wheels are per se known, for example from the EP 0 046 531.

A further significant variant of the invention comprises a closing subassembly which is mounted replaceably on the guide. This allows the closing subassembly to be entirely replaced easily and quickly, e.g. in case of the alteration of the cup or lid perimeters as mentioned before.

Other characteristics of the invention are a guide which can be adjusted in height relatively to the main frame, thanks to a height adjustment device. As the closing subassembly is held by the guide, a height adjustment of the guide simultaneously leads to an height adjustment of the closing subassembly. Such a height adjustment, however, can be independent of a vertical positioning of the closing tools, e.g. the sealing tools and be mainly used to move the closing subassembly as unobstructedly as possible to its exterior service position and back to its use position.

In a further embodiment of the invention a top plate is fixed to the main frame. The top plate is fixed to a base of the main frame by vertical guide columns and is spaced from the base at a different height.

The height adjustment of the guide mentioned above, according to other characteristics of the invention occurs in such way that underneath the top plate a secondary frame carrying the guide and the closing subassembly can be adjusted vertically on the guiding columns. The height adjustment device is fixed to the top plate and engages the secondary frame in order to adjust its height.

A further embodiment according to the invention permits a height adjustment of the whole secondary frame and, apart from that overall height adjustment a separate height adjustment of the closing subassembly. According to the invention this is made possible thanks to a division of the carrier element into an upper secondary-frame part and a lower secondary-frame part. The latter carries the closing subassembly, and both the lower and upper secondary-frame parts can be adjusted in height relatively to each other.

The height adjustment of the lower secondary-frame part relative to the upper secondary-frame part, can result, according to the invention, from the upper secondary-frame part carrying the lower secondary-frame part with the help of an eccentric positioning leading to the height adjustment.

It thereby is convenient if the upper secondary-frame part contains an eccentric shaft with at least one eccentric which pivots a crank whose free crank end is linked to the lower secondary-frame part.

The upper secondary-frame part conveniently contains an engine to drive the eccentric shaft. In order to achieve a sensitive positioning of the closing tools, e.g. the sealing tools, the engine located in the upper carrier element is an incrementally driven electric servomotor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
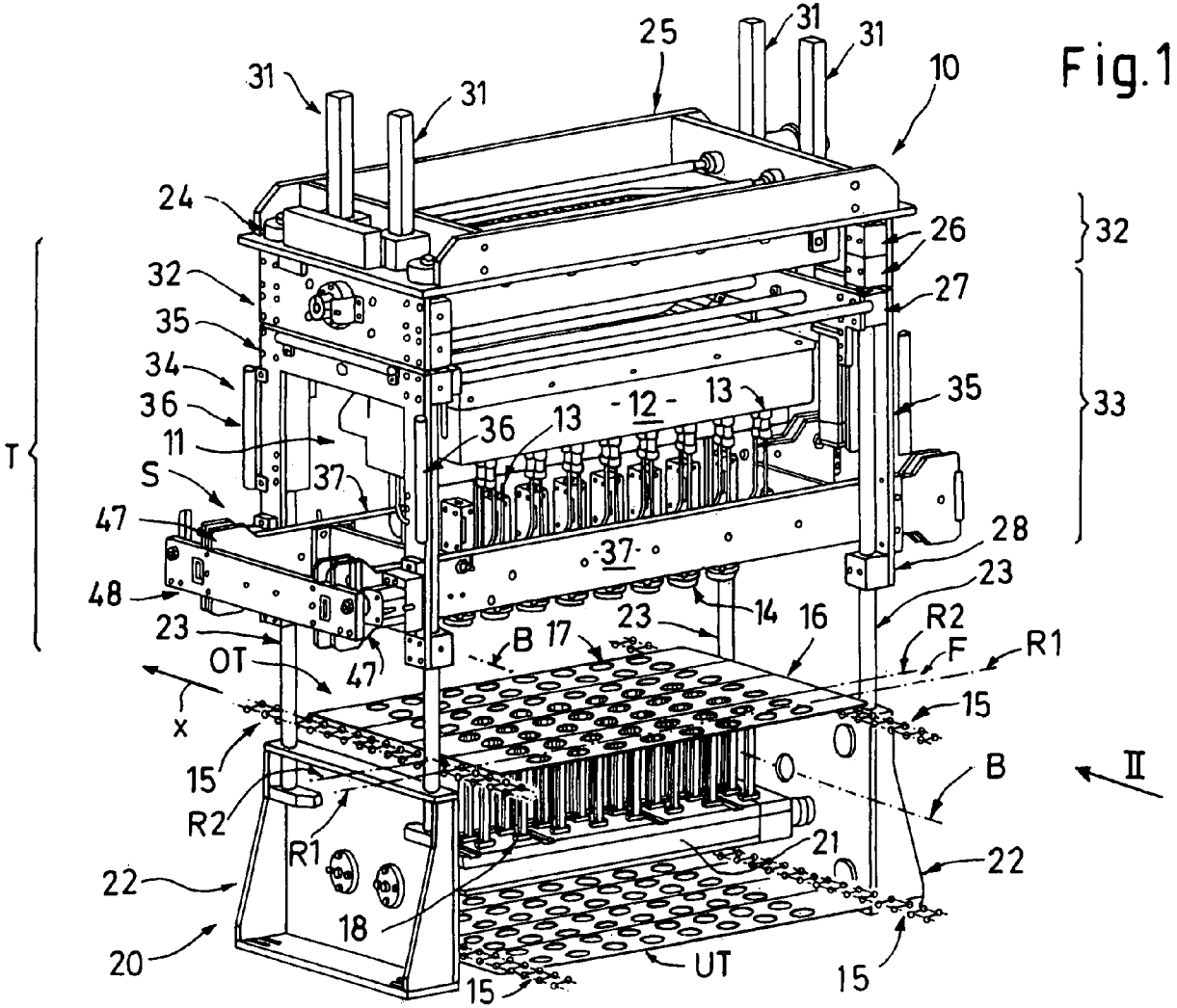
FIG. 1 is a partly schematic view of the apparatus according to the invention.
Figure 2:
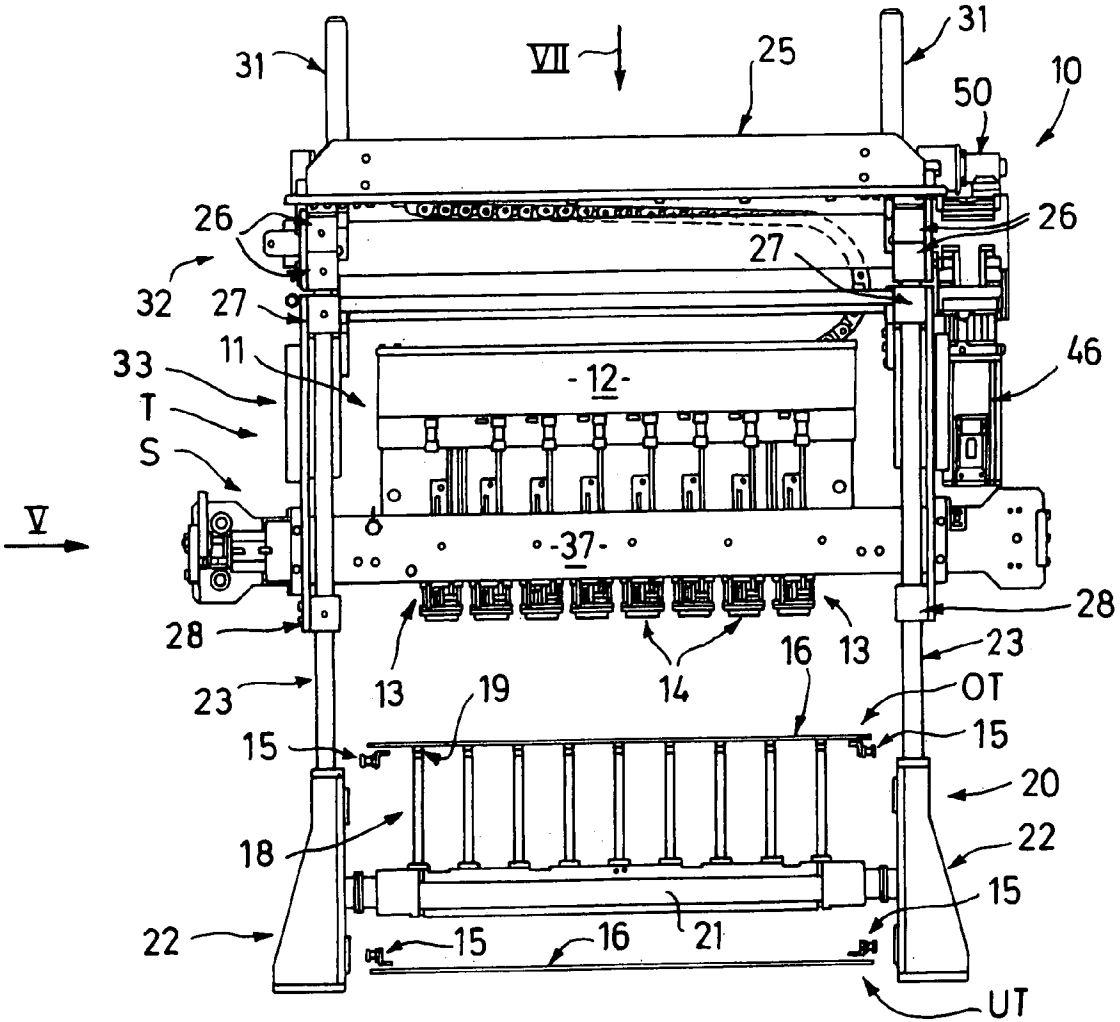
FIG. 2 is an end elevational view taken in the direction of arrow II of FIG. 1.

A frame 10 according to the invention is part of an apparatus for filling cups, bottles and other containers with foodstuffs and specialty foods, e.g. yogurt. The main frame 10 contains in particular a capping subassembly 11 with an upper assembly 12 holding sixteen cappers 13 that here are heat-sealing heads with sealing tools 14.

The main frame 10 is traversed by an endless chain-type conveyor F reeved at upstream and downstream ends over unillustrated sprockets or drums. The conveyor F has two Galls conveyor chains 15. The chains 15 carry transversely extending cell plates 16 formed with arrays of round cutouts or recesses each holding a polystyrene cup 17. Each cell plate 16 carries two rows R1 and R1 of cups 17. The rows R1 and R2 run perpendicularly to the transport direction x of the conveyor means F. From cell plate 16 to cell plate the cups 17 form columns or lines B parallel to the direction x.

The conveyor F forms an upper reach TO and a lower reach UT. The upper reach TO holds the cups 17 and moves them in the transport direction x. Thus each cell plate 16 forms two cup-receiving rows R1 and R2 with eight cups 17 each, for a total of sixteen cups per plate 16. Thus the sixteen sealing heads 13 of the capping subassembly 11 work simultaneously on sixteen cups 17, heat-sealing to the cup rims covers provided with a hot-melt adhesive coating on the undersides of their rims. The conveyor F is stepped in the transport direction x. The lower reach UT is used for the return of the conveyor F.

In order to make the cell plates 16, which are of stainless steel, as thin as possible and in order to prevent them from deforming, there are slide supports 18 arranged underneath and between the sealing heads 13 and having at their upper ends slide heads 19 made of a durable metal (e.g. bronze) that support the respective cell plate 16 from underneath. This way the sealing heads 14 can be pressed fairly firmly down against the cups 17 in the cutouts of the plates 16.

The whole main frame 10 is rigid, that is unmoveably fixed on a base 20 having two end walls 22 connected by cross bars 21. The end walls 22 each hold two upright guide columns 23, whose upper ends are fixed at 24 on a horizontally extending top plate 25. These elements 20, 21, 22, 23, and 25 are all fixed relative to one another.

Underneath the top plate 25 is a secondary frame T that can slide vertically by means of slide blocks 26, 27, and 28 on the columns 23 under control of a height-adjustment device H. The secondary frame T in-turn is formed by an upper part 32 and a lower part 33. The height adjustment device H is fixed to the top plate 25 and vertically shifts the upper part 32 of the secondary frame T. This height adjustment device H has four vertically acting threaded drives carried on the upper side of the plate 25. Threaded spindles 29 covered by tubular guards 31 engage the secondary frame T with their lower ends for a height adjustment of the upper frame parts 32. The lower part 33 carries the capping subassembly 11 that is guided and carried in the lower part 33 by means of a telescopic rail assembly S as described below.

The upper part 32 has slide blocks 26, and the lower part 33 has the blocks 27 and 28. The lower part 33 is provided at each side with an upper downwardly U-shaped frame 34 which has a horizontal member 35 and two legs 36 projecting downward and partially encompassing the columns 23. The upper end of the frame 34 carries the slide blocks 27 while the slide blocks 28 are provided at lower ends of the legs 36. Between the two legs 36 of different frames 34 is a connecting cross bar 37 that stabilizes the telescopic rail configuration S.

Figure 7:
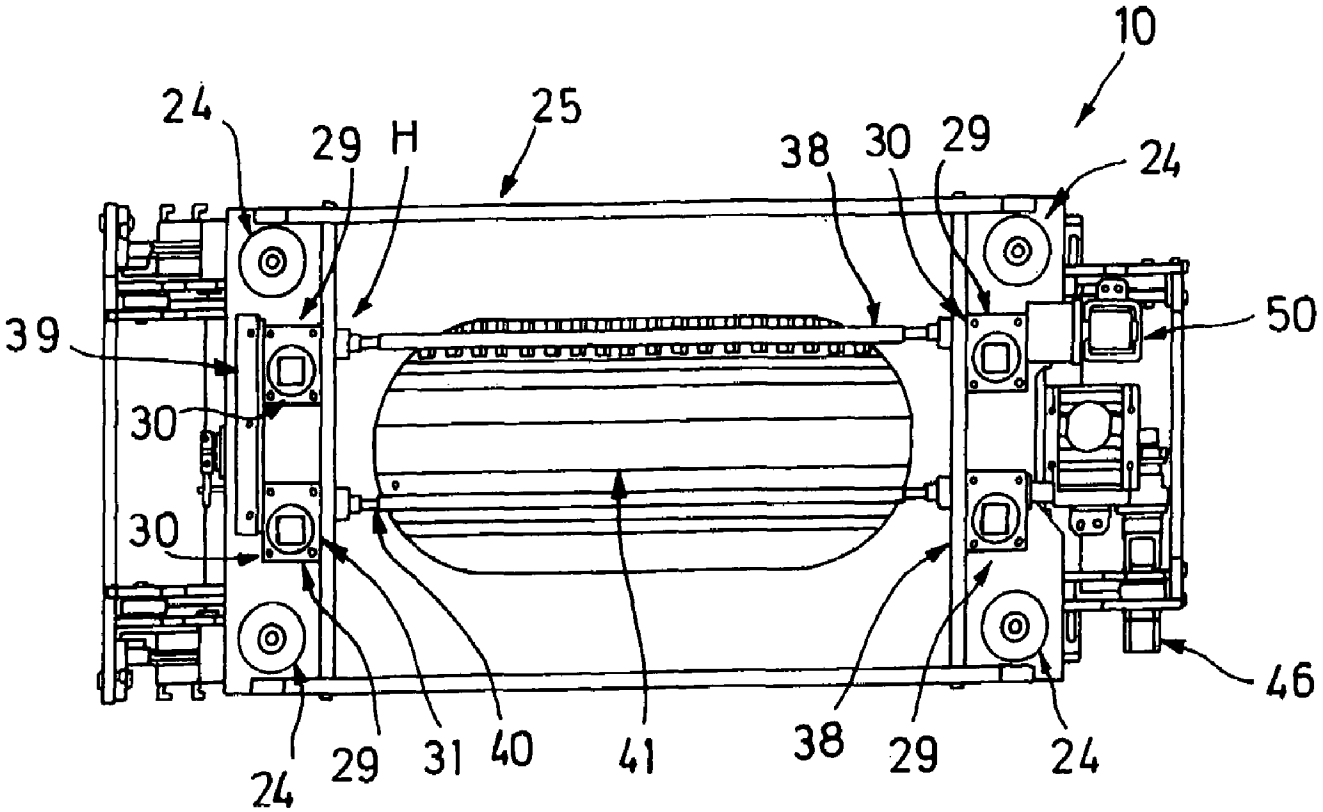
FIG. 7 is a top view taken in the direction of arrow VII of FIG. 2.

An electric motor 50 is connected to a nut assembly 30 shown at the upper right side of FIG. 7. This nut assembly 30 drives a transmission or synchronizing shaft 38 which drives the nut 30 on the upper left side of FIG. 7. This nut 30 is itself connected to the nut 30 at the lower left side as shown in FIG. 7 by a belt or transmission 39. The last mentioned nut 30 is itself connected to the nut 30 on the lower right side according to FIG. 7 by means a synchronizing shaft. Thus all four nuts 30 illustrated in FIG. 7 rotate synchronously, so that the thread spindles 29 can steadily move up and down, for an adjustment stroke of at most about 200 mm.

Figure 6:
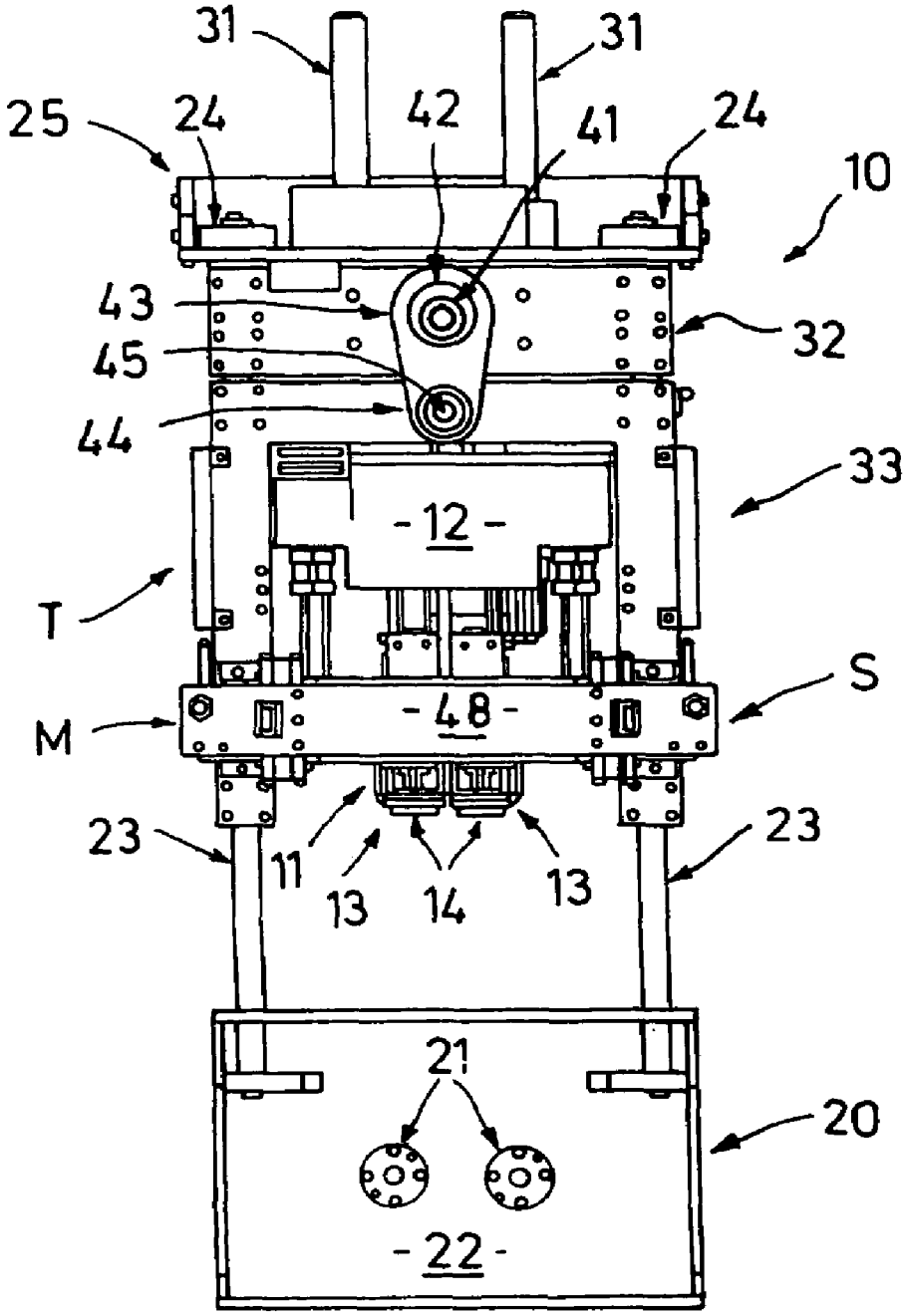
FIG. 6 is a view like FIG. 5 but with some parts left out for clarity of view.

In the drawings the secondary frame T is depicted in the respectively highest vertical position. The upper part 32 and the lower part 33 of the secondary frame T can be adjusted in height relatively to each other. More particularly, the upper part 32 carries the lower part 33 by means of an eccentric arrangement E effecting the relative height adjustment. The upper part 32 carries an eccentric shaft 41 that itself carries at each end an eccentric 42. The eccentrics 42 pivot respective cranks 43 whose free crank ends 44 are connected to an upper frame bar 35 of the lower part 33 by means of a bearing 45 (see also FIG. 6).

The eccentric shaft 41 is rotatably driven in a stepped movement by an electric servomotor 46 (see FIG. 7) so that a sensitive lifting action of the sealing tools 14 is guaranteed, once the whole secondary frame T has been adjusted relative to the lower base 21 by means of the height adjustment device H. The lifting caused by the eccentric arrangement E and the release lifting are both approximately 25 mm. The sealing elements of the sealing tools 14 are carried in a unillustrated way by springs, as for example air filled spring elements, so that height tolerances during the sealing process, which are dependant on the adjustment, can be balanced.

Figure 3:
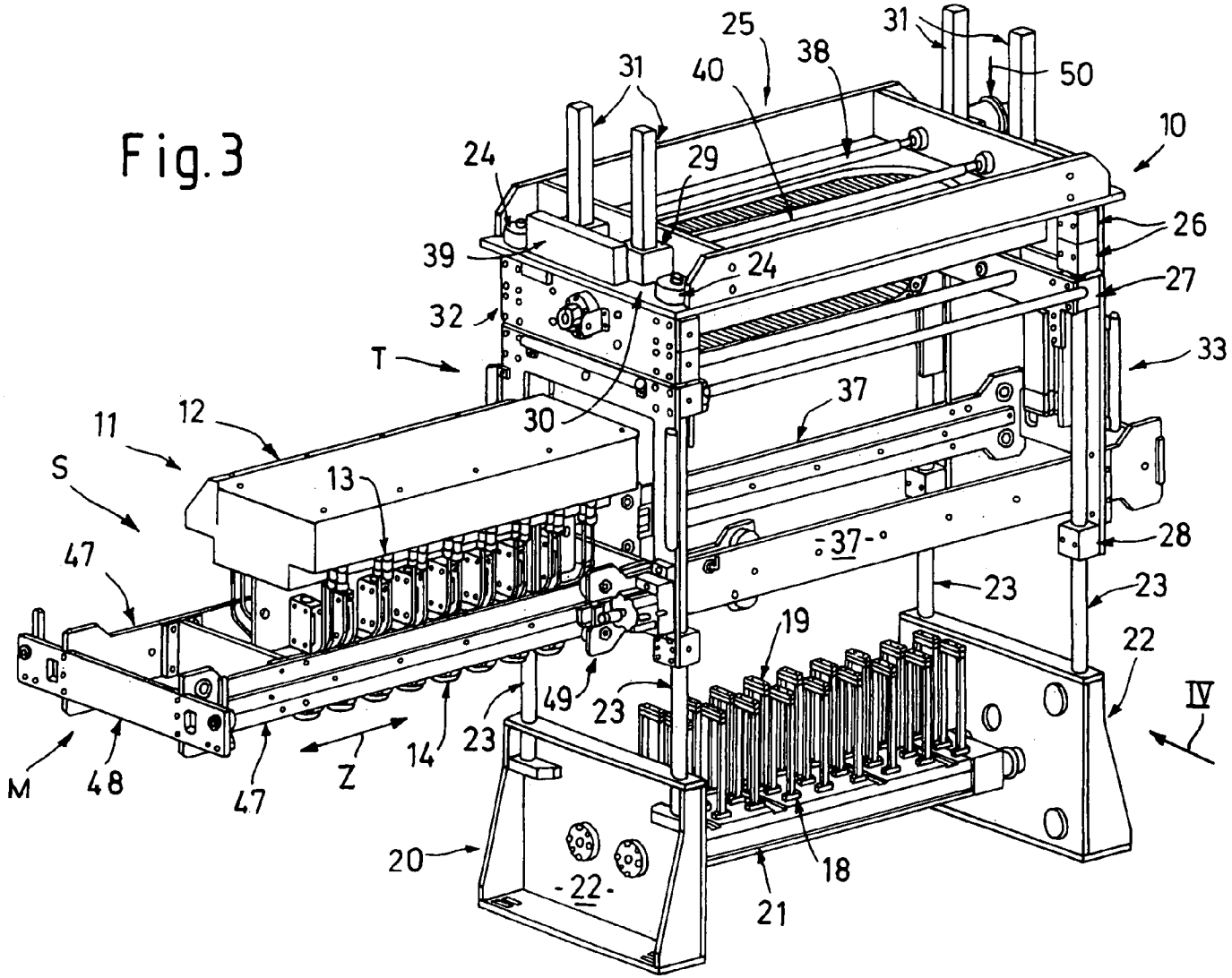
FIG. 3 is a perspective view like FIG. 1 but with the sealing subassembly in the service position.
Figure 4:
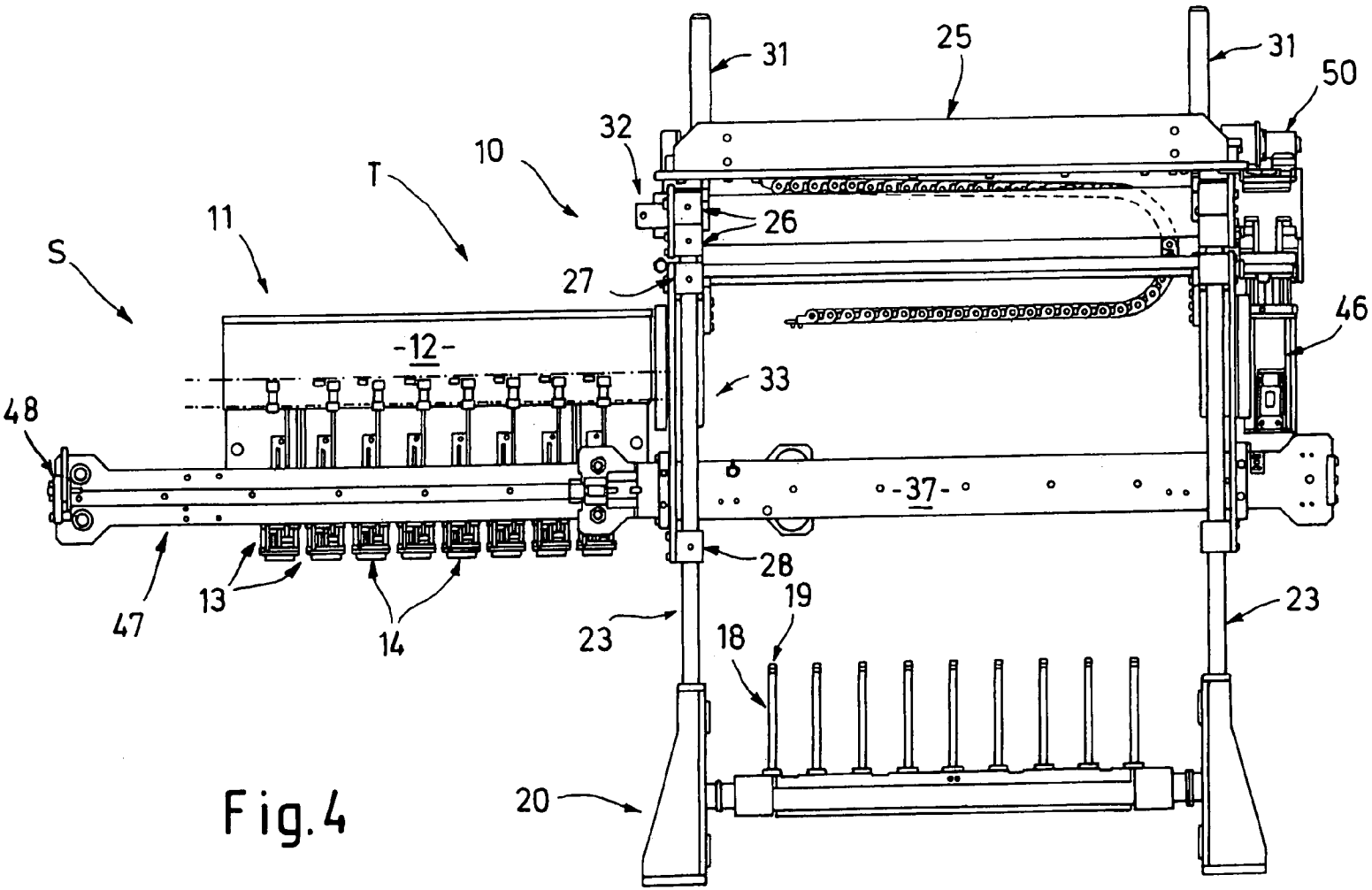
FIG. 4 is an end elevational view taken in the direction of arrow IV of FIG. 3.
Figure 5:
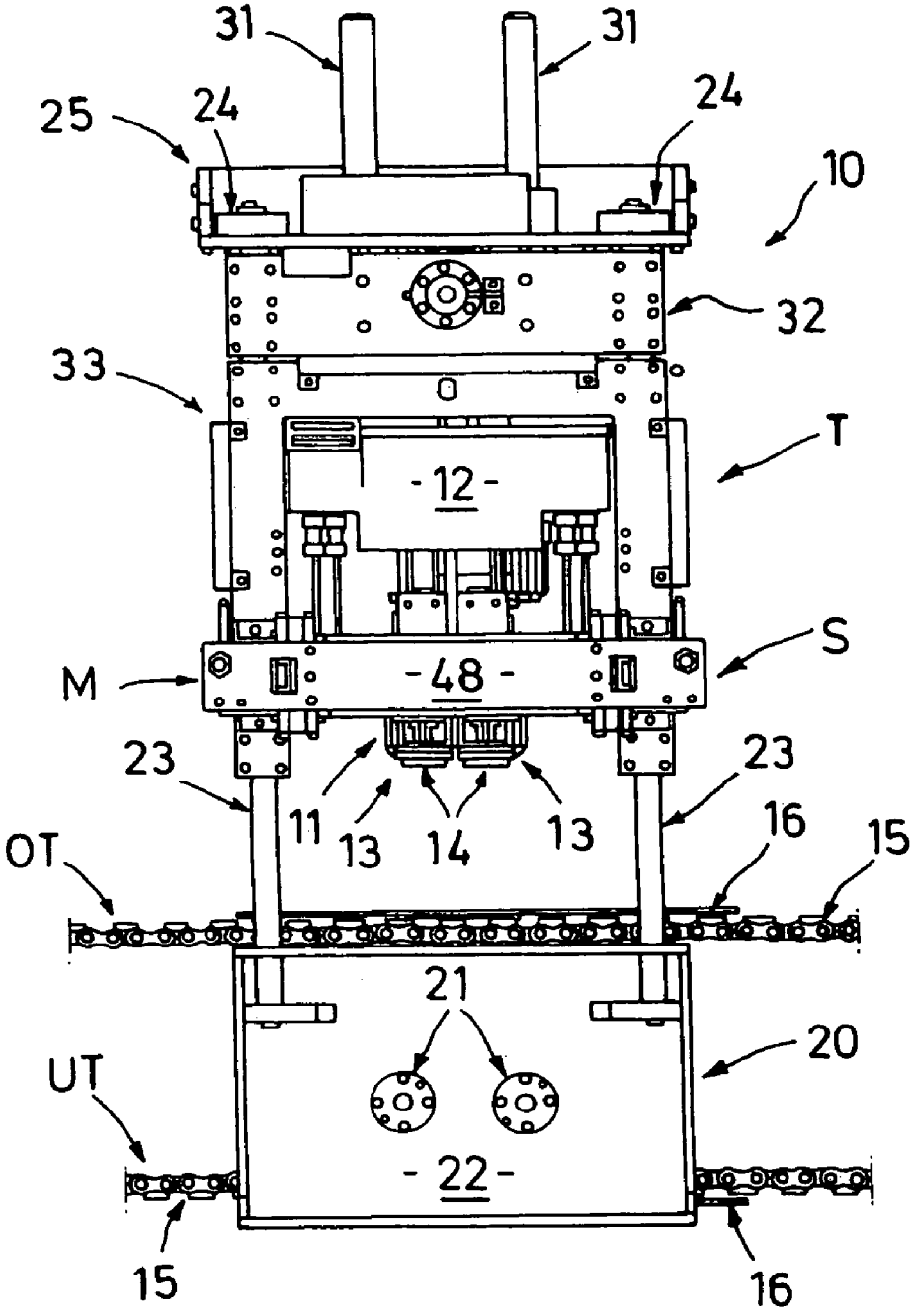
FIG. 5 is a side elevational view taken in the direction of arrow V of FIG. 2.

As mentioned above, the two connecting cross bars 37 of the lower part 33 of the secondary frame T are aligned parallel to each other and form a stationary part of a multi-part telescopic rail assembly S. Two inner telescopic rails 47 aligned parallel to each other are connected to each other at both ends by cross bars 48. These two inner telescopic rails 47 allow the capping subassembly 11 to be easily removed and repositioned and fixed again (not illustrated). FIGS. 3 and 4 illustrate that the inner telescopic rail unit M which can be moved back and forth in a translatory movement alongside the double arrow z perpendicular to the transport direction x is a component of the rail assembly S carrying the capping subassembly 11. With the help of the guide the maintenance or service position shown in FIGS. 3 and 4 can be easily and conveniently attained. In this position in particular the possibly contaminated sealing tools 14 can be easily cleaned without the conveyor F being affected by dirt onto it.

The two connecting cross bars 37 are provided with fixing devices 49 on their outer ends that interact with unillustrated counter fixing devices arranged at the inner faces of the cross bar 48. The fixing devices 49 latch the telescopic rail assembly S in its operating position while the inner telescopic rail unit M is positioned in its operating or use position inside of the main frame 10. In the operating position this fixing device can be loosened only if the whole device is turned off. To this end a controller for the entire apparatus has a sensor that detects the position of the secondary frame and prevents the conveyor F and sealing heads 13 from operating when the secondary frame is in the service position.

The invention claimed is:

1. In combination:

a conveyor moving in a horizontal transport direction through a closing station and having plates forming a succession of transverse rows of cutouts each holding a respective vessel;

a stationary main frame at the station through which the conveyor extends;

a secondary frame;

guide means carrying the secondary frame on the main frame for movement of the secondary frame between a use position in the main frame above the conveyor and a service position projecting transversely from the main frame and supported horizontally transversely offset from the conveyor;

first drive means for vertically shifting the secondary frame relative to the main frame and thereby setting a vertical position of the secondary frame relative to the main frame; and means including a plurality of respective sealing heads carried on the secondary frame for covering the vessels when the secondary frame is in the use position.

2. The combination defined in claim 1 wherein the secondary frame moves in a horizontal plane between the use and service positions.

3. The combination defined in claim 2 wherein the secondary frame moves in a straight line generally perpendicular to the transport direction between the use and service positions.

4. The combination defined in claim 3 wherein the guide means includes at least one telescoping rail connected between the main and secondary frames.

5. The combination defined in claim 3 wherein the sealing heads are releasably mounted on the secondary frame.

6. The combination defined in claim 3 wherein the secondary frame includes an upper part vertically but not horizontally shiftable on the main frame and a lower part carrying the heads, the first drive means being connected between the upper part of the secondary frame and the main frame.

7. The combination defined in claim 6 wherein the frame includes a stationary base;

a plurality of vertical columns fixed in the base; and a stationary top fixed at upper ends of the columns, the secondary-frame upper part being vertically shiftable along the columns and the first drive means being connected between the top and the secondary-frame upper part.

8. The combination defined in claim 7 wherein the lower part includes horizontal side rails spaced apart in the direction and extending transversely of the direction above the conveyor, the guide means being fixed on the side rails.

9. The combination defined in claim 7 wherein the first drive means includes respective vertically extending threaded spindles extending along the columns.

10. The combination defined in claim 9 wherein the first drive means includes a drive motor and a transmission between the drive motor and all the threaded spindles.

11. The combination defined in claim 10 wherein the drive motor is carried on the lower secondary-frame part and the threaded spindles are threaded into nuts on the top.

12. The combination defined in claim 7 wherein the first drive means can displace the upper part relative to the top through a greater distance than a distance the second drive means can relatively displace the upper and lower parts.

13. The combination defined in claim 7 wherein the upper and lower parts have slide blocks by means of which they ride on the columns.

14. The combination defined in claim 3, further comprising latch means for releasably securing the secondary frame in the use position.

15. The combination defined in claim 3 wherein the conveyor comprises a pair of parallel chains each lying in an upright plane extending parallel to the direction; and a plurality of transversely extending plates each formed with a transversely extending array of the cutouts.

16. The combination defined in claim 15 wherein the plates are relatively thin and flexible, the combination further comprising a plurality of supports fixed on the main frame and having upper ends engaging the plates between the cutouts, the plates sliding on the supports on movement in the direction.

17. In combination:

a conveyor moving in a horizontal transport direction through a closing station and having plates forming a succession of transverse rows of cutouts each holding a respective vessel;

a stationary main frame at the station through which the conveyor extends;

a secondary frame including an upper part and a lower part;

guide means carrying the lower part on the upper part for movement of the lower part between a use position in the main frame above the conveyor and a service position projecting transversely from the main frame and supported horizontally transversely offset from the conveyor;

first drive means for vertically shifting the guide means and upper part of the secondary frame relative to the main frame and thereby setting a vertical position of the secondary frame relative to the main frame;

means including a plurality of respective sealing heads carried on the secondary frame for covering the vessels when the secondary frame is in the use position; and second drive means for relatively vertically shifting the lower part relative to the upper part and thereby bringing the sealing heads vertically into and out of engagement with the vessels in the cutouts.

18. The combination defined in claim 17 wherein the drive means includes an eccentric.

19. The combination defined in claim 18 wherein the eccentric is carried on one of the parts, the other part carrying a crank carried on the eccentric.

20. The combination defined in claim 19 wherein the second drive means includes a motor on the one part carrying the eccentric.

21. The combination defined in claim 20 wherein the motor is a stepping motor.

* * * * *